United States Patent [19]

Rimmer

[11] 4,381,862

[45] May 3, 1983

[54] FEED CHANNELS FOR POOL TABLES

[76] Inventor: Norman L. Rimmer, The Old Golf House, Whaley Bridge, Stockport, England

[21] Appl. No.: 227,277

[22] Filed: Jan. 22, 1981

[30] Foreign Application Priority Data

Jan. 26, 1980 [GB] United Kingdom ..... 8002716

[51] Int. Cl.[3] ..... A63D 15/00

[52] U.S. Cl. ..... 273/11 C

[58] Field of Search ..... 273/11 R, 11 C, 182 R, 273/182 A, 201

[56] References Cited

U.S. PATENT DOCUMENTS

| | | | |
|---|---|---|---|
| 357,853 | 2/1887 | Parker | 273/11 R |
| 808,051 | 12/1905 | Hege et al. | 273/11 R |
| 1,174,151 | 3/1916 | Hobbs | 273/11 R |
| 1,222,284 | 4/1917 | Grode | 273/11 R |
| 1,224,410 | 5/1917 | Porte | 273/182 A X |
| 1,507,479 | 9/1924 | Hand | 273/11 R |
| 1,558,209 | 10/1925 | Treiber | 273/11 R |
| 1,630,345 | 5/1927 | Lanza | 273/11 R X |
| 1,693,116 | 11/1928 | Lee | 273/11 R |
| 1,703,448 | 2/1929 | Horstmann | 273/11 R |
| 2,047,048 | 7/1936 | Abbot et al. | 273/11 R |
| 3,441,273 | 4/1969 | Woods | 273/11 R |
| 3,466,036 | 9/1969 | Connelly et al. | 273/11 C |
| 3,466,037 | 9/1969 | Miller | 273/11 C |
| 3,495,825 | 2/1970 | Nielsen | 273/11 R |
| 3,497,048 | 2/1970 | Le Mieux et al. | 273/11 C |
| 3,967,821 | 7/1976 | Bagley | 273/11 C |

*Primary Examiner*—Richard C. Pinkham
*Assistant Examiner*—Matthew L. Schneider

[57] ABSTRACT

A games table, particularly a coin-feed pool table, has a playing surface bounded by cushions containing pockets supported on a floor-standing housing. Within the housing the pockets are joined by channels to a ball outlet in a side wall of the housing and also to an internal ball-storing racking arrangement.

In order to avoid jamming of the balls due to dirt deposits, the channels and also the racking arrangement have edge structures along which the balls run.

The racking arrangement may comprise feed channels leading to a storage rack via an aperture through which the smaller cue ball can fall to be returned to the player if pocketed during a game. The larger object balls run over the aperture to the rack.

The channels joining the pockets with the racking arrangement may be formed by rods held together by spaced supports which may comprise annular clips having recesses which engage the rods.

6 Claims, 7 Drawing Figures

FEED CHANNELS FOR POOL TABLES

The present invention relates to ball racking arrangements and feed channels for pool and similar tables.

Pool tables are frequently installed in public places and their operation controlled by a coin-operated mechanism. The table must provide for the return of the cue ball throughout the game but the trapping of the object balls after they are pocketed. To this end feed channels lead from the pockets or boots disposed around the periphery of the table to a central collection point where a ball selection arrangement provides for the retention of the object ball and, until the game is over, the return of the cue ball.

Because of the use to which such tables are subjected, it has been found that dirt builds up in the feed channels, and foreign objects are sometimes deposited therein which either adversely affects the rolling motion of the balls or partially or completely obstructs their passage. This problem can be obviated by regular service and cleaning but such service and cleaning is difficult and expensive and does not overcome the problems caused by removing the table from use whilst this is attended to.

Presently used racking arrangements also cause problems, because the selection of the cue ball from the object balls is sometimes less than reliable and the balls can often be displaced from the rack by shaking the table which defeats the purpose of the coin-operated mechanism.

According to one aspect of the present invention there is provided a games table for playing games such as pool of the kind comprising a floor-standing housing supporting a top playing surface, pockets at the periphery of said surface, a ball outlet at a side of the housing, a racking arrangement for storing balls within the housing, and channels within the housing interconnecting said pockets, said outlet and said racking arrangement, characterised in that said channels and racking arrangement have edge structures along which the balls are adapted to run.

According to a further aspect of the present invention, there is provided a racking arrangement for a games table as described above comprising a rack having means for aligning balls along a single axis and, feed means for feeding balls to the rack, said feed means being displaced from the rack by means of an aperture and being such that balls of a certain larger diameter are fed over the aperture onto the rack and a ball of a certain small diameter is allowed to drop through the aperture until the collection of a predetermined number of larger balls on the rack prevents such dropping through.

According to another aspect of the present invention, there is provided a channel for conveying a ball from one point to another under the surface of a pool table comprising a base formed to provide two rails extending therealong.

In one form the channel is extruded from aluminium and the rails are formed by two parallel upstanding projections. In another form the channel is moulded from synthetic plastics material and the rails are defined by the opposite edges of a recess formed in and extending along the base of the channel.

According to a still further aspect of the present invention, there is provided a channel for conveying a ball from one point to another comprising at least three rails extending between a pair of supports, one of the rails providing a base support for the ball and the other two providing lateral support for the ball.

According to yet a still further aspect of the present invention there is provided a support of generally annular cross-section defining at least three spaced recesses formed to accommodate three spaced rods one of which is to form a channel base and the others of which are to form channel walls.

In order that the invention may be more clearly understood, one embodiment of the invention will now be described, by way of examples with reference to the accompanying drawings, in which.

Figure 1:
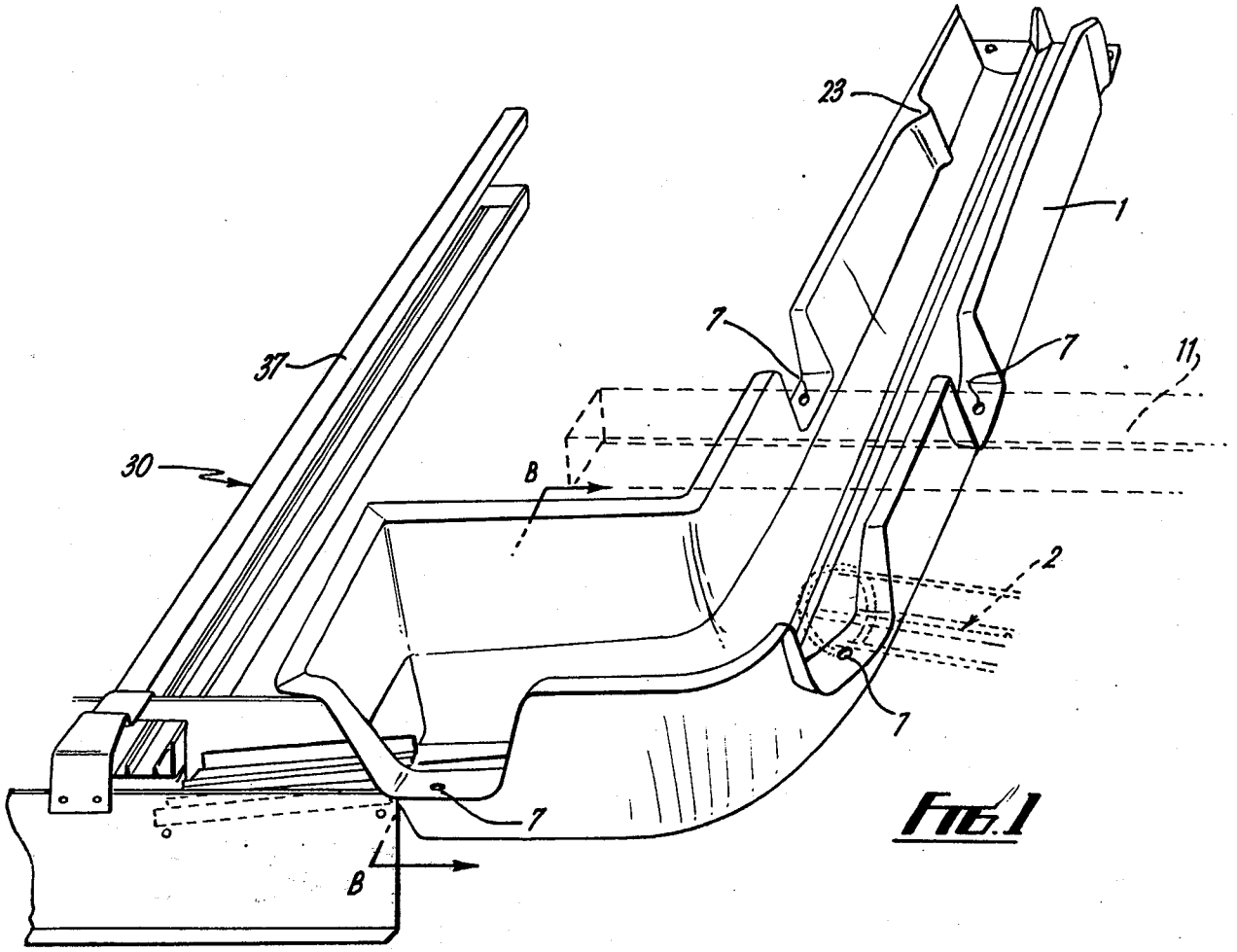
FIG. 1 shows an end perspective view of a central feed channel and ball racking arrangement for a games table according to the invention such as is shown in FIG. 7.
Figure 2:
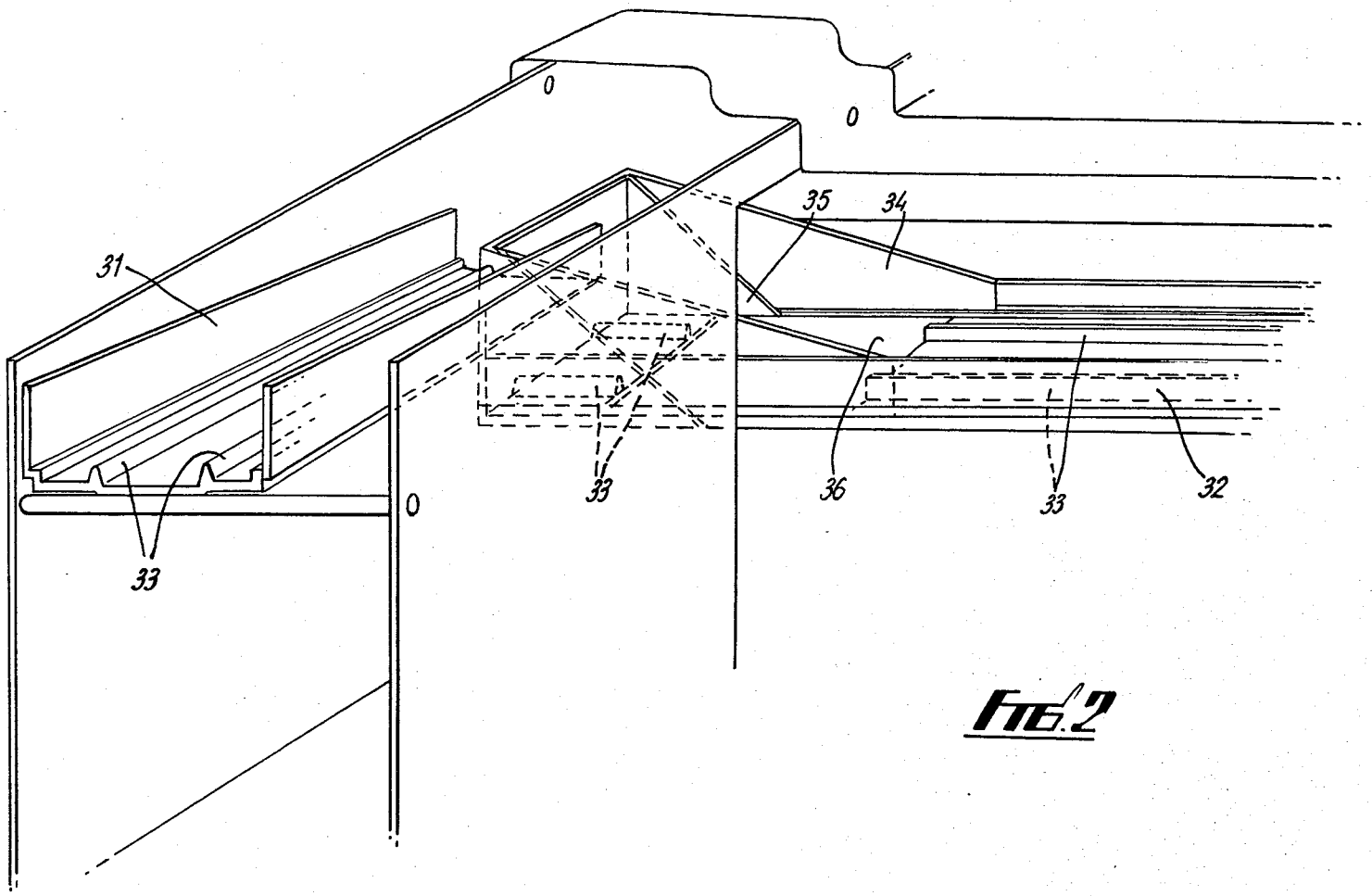
FIG. 2 shows a perspective view from the front and side of part of the racking arrangement of FIG. 1.
Figure 4:
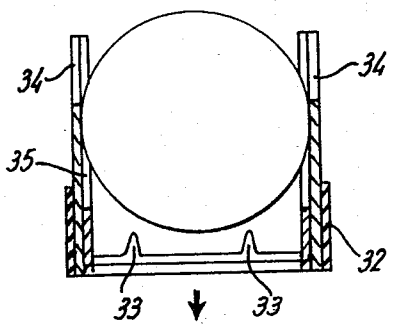
FIG. 4 shows a sectional view taken along the line A—A of FIG. 3.
Figure 3:
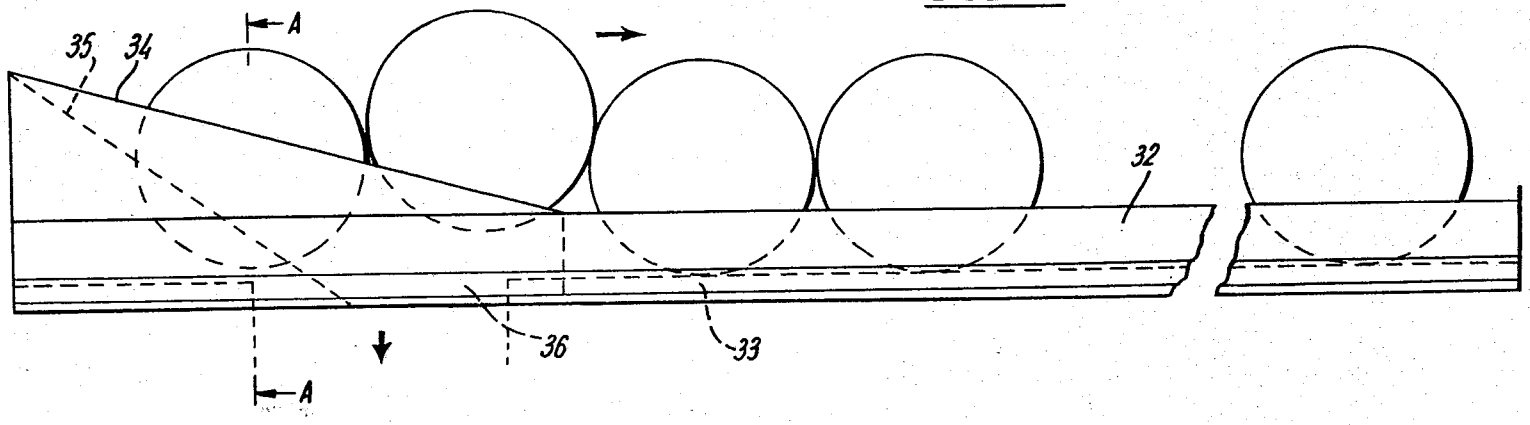
FIG. 3 shows a side elevational view of the rack of the racking arrangement of FIGS. 1 and 2.
Figure 5:
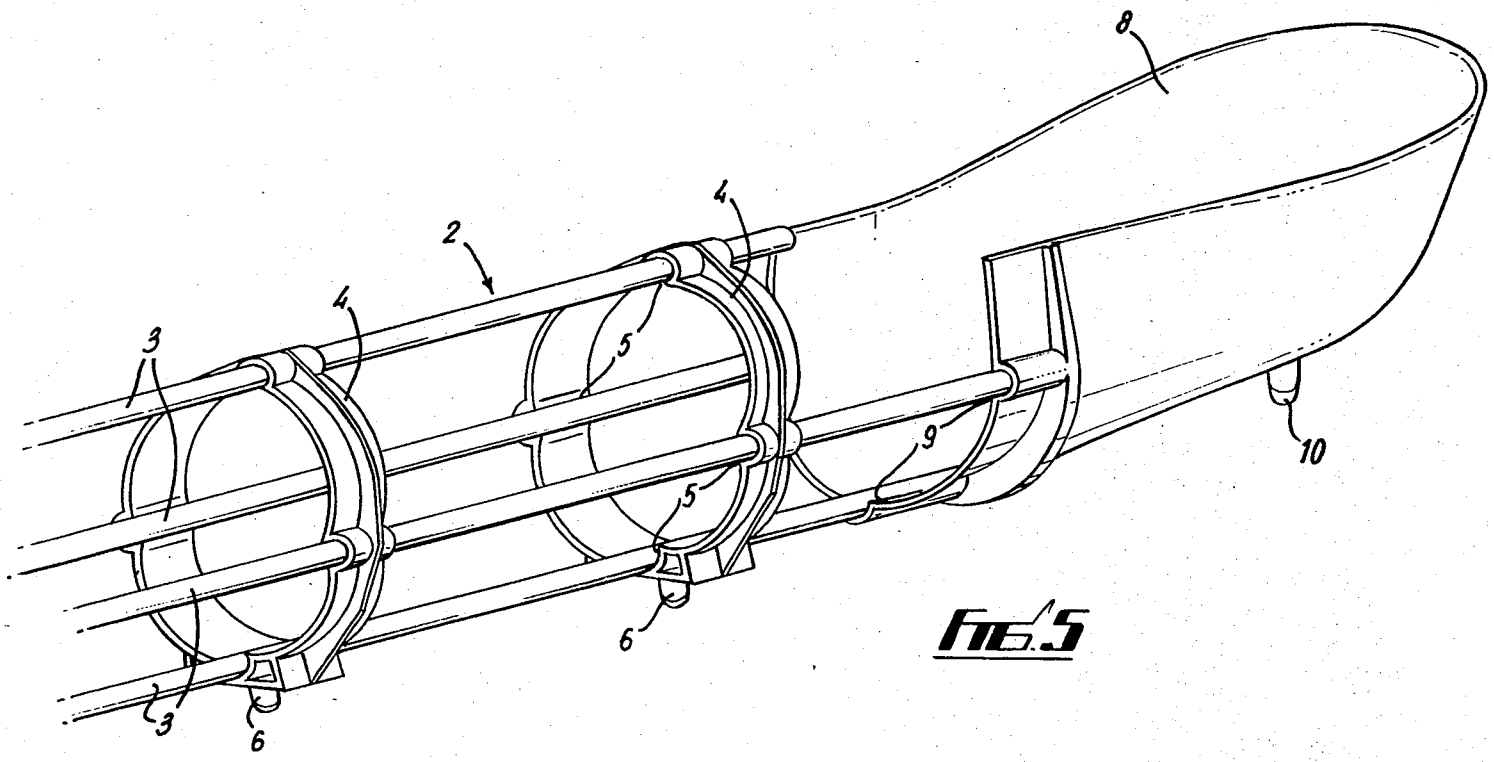
FIG. 5 shows a perspective view of a ball collection pocket and feed channel.
Figure 7:
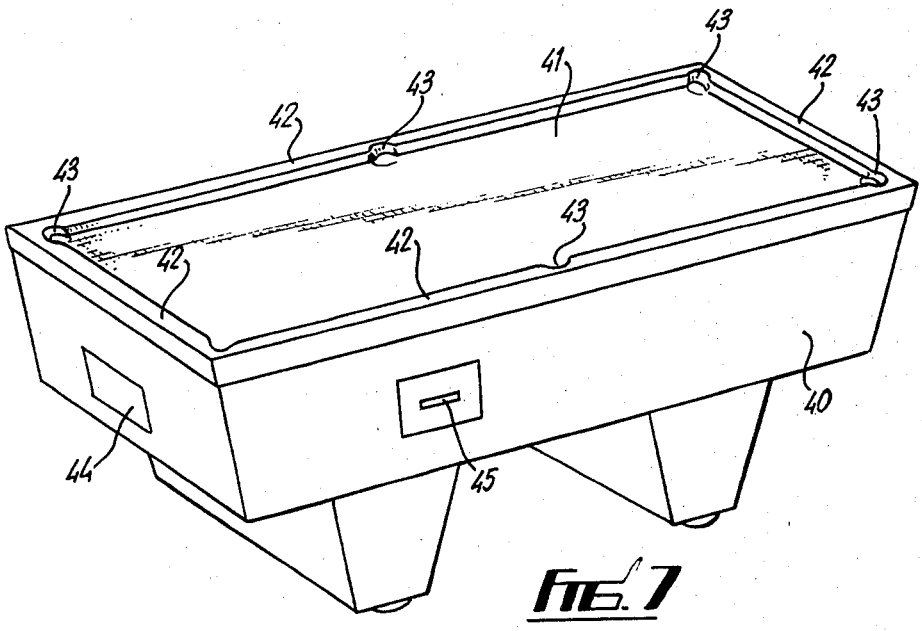
FIG. 7 shows one form of a game table according to the invention.

The games table of FIG. 7 is generally conventional and comprises a floor-standing cabinet or housing 40 having a top surface 41 defined by a sheet of slate with a green baize covering. The top surface is bounded by cushions 42 containing six ball collection pockets 43. The housing has a ball outlet 44 in one side wall and a coin mechanism 45 in a further side wall. These pockets 43 comprise boots moulded from synthetic plastics material and are connected to a central connection feed channel 1 by means of respective channels 2 (see FIG. 5). Each channel 2 comprises sections composed of four rods 3 extending between pairs of rod supports 4. The rods 3, which are either zinc plated or synthetic plastics material coated steel, are arranged so that the lowermost one provides a base for a ball running in the channel and the outermost ones provide lateral support for the ball. The upper rod prevents the ball jumping out of the channels. Each rod support is a moulding of synthetic plastics material. The moulding is of generally annular form and defines four equi-distantly spaced recesses 5 and a spigot 6 on its base. In assembly the channel rods are clipped into the recesses 5 and then the spigots are plugged into complementary locating recesses. Complementary locating recesses are referenced 7 in the central channel 1 (see FIG. 1) and the end of each feed channel 2 remote from the boot (referenced 8 in FIG. 5) is fixed to the central channel by the engagement of the appropriate spigots in these recesses 7. As can be seen in FIG. 1 the walls of the central feed channel 1 are formed to accommodate these ends of the channels (see feed channel shown in dotted outline in FIG. 1).

Each channel 2 is also connected to the corresponding boot by the rods 3. The free end of three of these rods engage in recesses 9 moulded into the boot 8. The boot 8 is also formed on its base with a spigot 10 to enable location of the boot 8 on the remainder of the table. The slate of the table surface is supported on wooden cross-members 11 (dotted outline in FIG. 1)

and these cross-members provide fixing points for the central feed channel 1 disposed below them. The formation of the recesses 7 and of the channel walls to accommodate the ends of the channels is such that the channels can join the outside channel 1 at any one of a number of angles so as to allow for differing table sizes. The spacing of the rods 3 in the channels 2 is such as to retain the balls therein but allow foreign objects to fall through to prevent an obstruction occurring. The point contact of these rods 3 with a ball rolling on them inhibits the build-up of dirt and grease thereon as the curved surfaces promote self-cleaning. The waisted shape of the boot 8 promotes rapid settling of a ball deposited in it and prevents the ball flying out.

Figure 6:
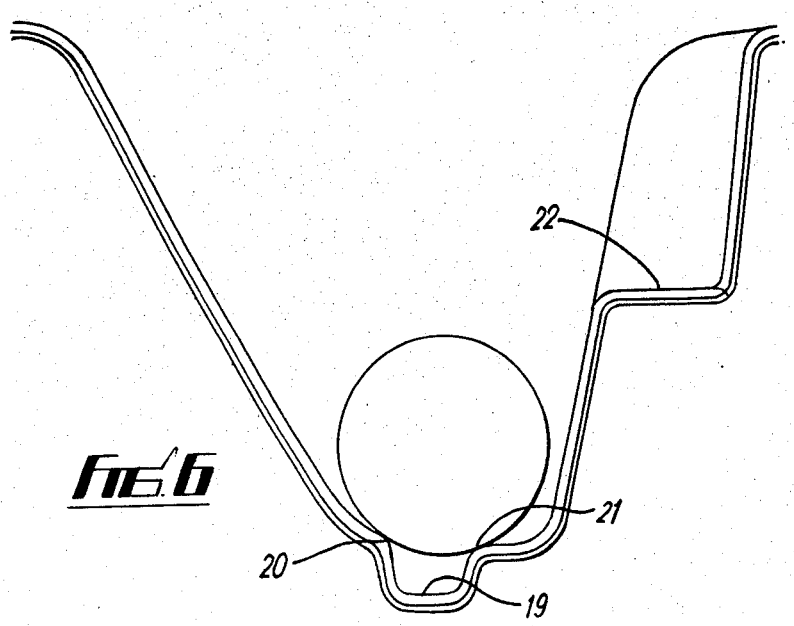
FIG. 6 shows a section along the line B—B of FIG. 1.

The channel 1 is vacuum-formed from synthetic plastics material. A section through it along the line B—B is shown in FIG. 6. The base of the channel is formed with a longitudinally extending dependent recess 19 the edges 20 and 21 of which form two rails down which a ball can roll in a controlled manner. There is a gradual fall in the base of the channel along its length in the direction towards the racking arrangement which is referenced generally 30 in FIG. 1. Any small, particulate dirt which manages to pass through the channels 2, perhaps by adhering to the balls, collects in the recess 19 and does not impede the ball. The walls of the channels 1 are formed high to prevent balls jumping out and curved to guide balls under control down to the edges on rails 20 and 21 prevent stacking. Reference 22 indicates the platform on which the end of the channel 2 sits. In most cases balls delivered to the central channel 1 lose momentum immediately on entry due to impact with a channel wall. Where this does not occur, one or more stops 23 are provided to slow down the ball on entry to the channel 1.

Balls are delivered from the central feed channel 1 to the rocking arrangement 30. This comprises a feed rack 31 and a storage rack 32. An extruded aluminium twin ramp arrangement 33 connects the feed rack 31 to the storage rack 32. Both racks 31, 32 are of extruded aluminium and comprise a pair of rails 33 on which the balls roll. Thus each ball is guided accurately along the same path. The two ramps, referenced 34 and 35, have differing gradients. The ramp 35 is disposed within the ramp 34 and both ramps are within the rack 32. Ramp 34 has the smaller gradient and leads over an aperture 36 formed in the rack 32 through which the smaller cue ball can fall. Ramp 34 leads to the aperture 36.

This racking arrangement operates as follows. When an object pool ball is delivered to the rack 31 via a channel 2 and the central feed channel 1 it rolls down the large width rack 34, across the aperture 36 and is stored on the rails 33 of the rack 32. All object balls follow this path from a boot to the rack 32. If, before all the object balls are pocketed, the cue ball enters a boot it is also fed to the rack 33 via the channels 2 and 1. In contrast to the object ball, however, the smaller cue ball rolls down the steeper gradient smaller width ramp 35 and through the aperture 36 to be delivered back to the player through the ball outlet 44. When all the object balls are on the rack 32 the last racked object ball partly obscures the apertures 36 thus preventing the cue ball, when next delivered to the rack 31, from falling through the aperture. All balls are then locked in position and can only be released by releasing the rack 32.

Rack 32 release is provided for by pivotally mounting the rack for pivotal movement along an axis parallel to the longitudinal axis of the rack. The pivotal mounting can be locked and the lock released on operation of the coin mechanism 45 to enable the rack 32 to be pivoted to deliver all the racked balls back to a player at the outlet 44. The rack 32 is provided with a canopy 37 to prevent the balls being shaken out of the rack.

It will be appreciated that the precise axial alignment of the object balls by the rails 33 on the rack 32 enables the precise length of all the stored object balls to be predetermined. This in turn enables the aperture to be precisely positioned and constructed so as to prevent return of the cue ball when all object balls are stored.

It will also be appreciated that the balls always run on edge structures and that as a result build-up of dirt, which occurs on a flat surface, is inhibited.

I claim:

1. A games table for playing games such as pool with object balls and a smaller diameter cue ball, said table being of the kind having a floor-standing housing supporting a top playing surface, pockets at the periphery of said surface, a ball outlet at a side of the housing, a racking arrangement for storing balls within the housing, and channels within the housing interconnecting said pockets, said outlet and said racking arrangement, said channels and racking arrangement having rails along with the ball are adapted to run, and wherein said racking arrangement comprises:

an elongate rack pivotable between a storage position at which balls are stored on said rack and a delivery position at which said balls are discharged from said rack for delivery to the player;

said rack having said rails therealong arranged to align said balls along a single axis in said storage position of said rack;

an elongate feed structure for feeding balls to the rack, said feed structure having said rails therealong for guiding said balls;

an aperture between said feed structure and said rack through which said smaller diameter cue ball can drop but not the larger diameter said object balls;

a first downwardly inclined ramp defined by spaced-apart rails connecting said feed structure with said rack and along which said larger diameter object balls can run over said aperture to said rack; and a second downwardly inclined ramp defined by spaced-apart rails connecting said feed structure with said aperture and along which said smaller diameter cue ball can run to said aperture, said rails of said second ramp being below and between and of steeper inclination than said rails of said first ramp;

whereby when all object balls have been fed to said rack, the last said object ball is supported on said first ramp and is then operable to hold said cue ball on said second ramp and thereby block same from dropping through said aperture.

2. A games table according to claim 1, wherein:

said rails on said rack and said feed structure comprise upstanding projections of channel members.

3. A games table as specified in claim 1 wherein:

each said channel comprises sections, each section composed of a pair of longitudinally spaced, annular rod supports, each with at least three rod recesses equidistantly spaced around the inner face thereof;

and at least three rods extending longitudinally between said pair of annular rod supports, a single said rod being seated in a pair of bottom said recesses to define a single rail along with said balls can roll and two further said rods being each seated in a pair of said recesses, at one of the opposite sides of said channel section, above said central rail, to provide lateral support for said balls.

4. A games table as specified in claim 3 wherein:

each said channel section also has a fourth rod extending longitudinally between and seated in a pair of said recesses at the top of said pair of rod supports for preventing said balls from jumping out of said channel.

5. A games table as specified in claim 4 wherein:

each said rod support comprises a one piece, plastic moulding of generally annular configuration having an inner circumferential surface in which there are four equidistantly spaced recesses forming seats into which the adjacent portions of said rods are clipped.

6. A games table as specified in claim 5 wherein:

each said rod support has an integral mounting spigot projecting downwardly from the bottom thereof.

* * * * *

UNITED STATES PATENT AND TRADEMARK OFFICE

CERTIFICATE OF CORRECTION

PATENT NO. : 4,381,862

DATED : May 3, 1983

INVENTOR(S) : Norman L. Rimmer

It is certified that error appears in the above-identified patent and that said Letters Patent is hereby corrected as shown below:

On the title page Insert:

-- (73) Assignee: Hazel Grove Music Company, Ltd.
Chesire, England --

-- Attorney, Agent or Firm; Pearson & Pearson --.

Signed and Sealed this

Nineteenth Day of July 1983

[SEAL]

*Attest:*

GERALD J. MOSSINGHOFF

*Attesting Officer*

*Commissioner of Patents and Trademarks*